United States Patent [19]

Dragich

[11] Patent Number: 4,822,209

[45] Date of Patent: Apr. 18, 1989

[54] ELONGATED CONCRETE GROOVER

[76] Inventor: Nicholas Dragich, 17 Fairway, Orchard Park, N.Y. 14127

[21] Appl. No.: 158,926

[22] Filed: Feb. 22, 1988

[51] Int. Cl.[4] ..... E01C 23/02

[52] U.S. Cl. ..... 404/89; 404/97

[58] Field of Search ..... 404/87, 89, 93, 97; 15/235.3, 235.4; 425/458

[56] References Cited

U.S. PATENT DOCUMENTS

| | | | |
|---|---|---|---|
| 775,110 | 11/1904 | Jumper | 15/235.3 |
| 1,273,060 | 7/1918 | Hoff | 404/97 |
| 1,283,761 | 11/1918 | Hendricks | 404/89 X |
| 1,950,673 | 3/1934 | Heltzel | 404/89 X |
| 2,617,336 | 11/1952 | Brickler | 404/89 |
| 2,947,084 | 8/1960 | Billings | 15/235.3 X |
| 3,936,210 | 2/1976 | Oehlerking | 404/89 |
| 3,947,916 | 4/1976 | Mitchell | 425/458 X |
| 4,253,816 | 3/1981 | Tobias et al. | 404/89 X |
| 4,299,513 | 11/1981 | Stegmeier | 404/97 |
| 4,397,581 | 8/1983 | Jarvis | 404/97 |
| 4,723,869 | 2/1988 | Dragich | 404/97 |

*Primary Examiner*—Jerome W. Massie
*Assistant Examiner*—Matthew Smith
*Attorney, Agent, or Firm*—James J. Ralabate

[57] ABSTRACT

A groover tool for use in putting a groove in wet cement. This tool is elongated and has a movable handle which minimizes abrupt pressure changes in the handle, thus accomplishing an even pressure and a more uniform groove. The groover tool has a tapered groove rib which also aids in the formation of a uniform groove. A third feature on the groover tool is the weight-retaining means for holding weights in place and allowing a substantially uniform pressure to be applied along the entire length of the tool.

9 Claims, 2 Drawing Sheets

ELONGATED CONCRETE GROOVER

This invention relates to a concrete groover and, more particularly, to a novel elongated concrete groover.

BACKGROUND OF THE INVENTION

It is known to use various tools to impart a groove in wet cement or concrete when installing driveways, sidewalks and the like. When using the conventional grooving tools generally it is necessary for the workman to stand on a plank or kneeboards so as not to leave any undesirable impressions in the wet concrete. Usually, the groover tool is a short flat rectangular unit having extending from its lower face a groove-making extension or rib which makes the necessary indentation in the wet cement. Also, because of the normal work habits of a workman and because of the progressive hardening of the cement, different pressures are exerted upon the grooving tool thereby resulting in grooves of non-uniformity.

There have been various attempts to rectify some of the drawbacks of conventional grooving tools such as use of extensions or handles to provide means for avoiding the necessity of standing on planks or other walkways over the wet cement. Some of these are disclosed in U.S. Pat. Nos. 775,110; 1,027,396; 3,758,909; 4,155,141 and 4,397,581. In 775,110 (Jumper) a tool for cement work is disclosed wherein the tool edges the surface of cement. The tool has a handle attachment whereby the handle is immovably fixed to the tool by lug 17. A problem encountered with handles of this nature is that as the groover is moved forward or backward it may dig into the wet cement and cause unwanted impressions. Also, it is difficult to maintain a constant pressure on the groover because of the different angles of pressure exerted because of the fixed handle. It would be desirable if a tool with a longer groover, flexible handle and constant weight means was provided for this type work.

In Abram, U.S. Pat. No. 1,027,396, a trowel attachment is disclosed wherein the trowel blades can be applied in various combinations to a trowel blade so that a plurality of grooves can be made at the same time in the cement surface. Abram also discloses the use of handle 5 that is fixed in place by means of a bolt 6 which extends through a bearing lug 3 to rigidly fix the handle to the trowel.

In Granger, U.S. Pat. No. 3,758,909, an edger is disclosed having a handle wherein the plate is bent to form the edging surface. Granger's handle is secured in place at a fixed angle by bolt 26 and nut 28. Granger uses a rigid plate or blade having at least one marginal edge with a depending lip-like concrete contouring and shaping flange. To this plate is secured an elongated handle for use while the workman is standing. The disadvantage of this type handle is similar to those prior art tools above discussed. When the handle is attached at a fixed angle there is a potential for the tool to dig into the wet cement and cause deformed grooves or impart otherwise undesirable impressions.

Guerra U.S. Pat. No. 4,155,141 teaches the use of a tool for simultaneously finish edging the wet cement surfaces abutting both sides of divider strips which separate the wet slabs. Guerra uses a pivotable handle by the use of wing nuts 31. To adjust the angle of the handle attachment, wing nuts 31 are loosened, then handle moved to the desired angle, and then the wing nuts are tightened to fix the handle in place at a single angle. The angle does not adjust itself during movement of the tool since the wing nut 31 is tightened in one position. Again, it is desirable for a tool for working with wet cement to be freely adjustable during use so that pressure on the cement can be better controlled and more uniform grooves can be imparted.

In Jarvis U.S. Pat. No. 4,397,581 a combination hand trowel-groover is disclosed. The trowel has a wing nut 28 for fixing the angle of the handle 3 to the surface of flanges 18 and 19. The angle of attachment is not free to adjust itself during movement.

SUMMARY OF THE INVENTION

It is therefore an object of this invention to provide a cement groover that is devoid of the abovenoted disadvantages.

Another object of this invention is to provide an elongated groover having a handle means that can swivel when in use.

A further object of this invention is to provide an elongated groover that is adapted to impart a more uniform groove in the surface of wet cement.

A yet further object of this invention is to provide a grooving tool that can accept and hold weights in place, said weights assisting in imparting a uniform pressure upon the cement surface.

Still another object of this invention is to provide a grooving tool that can accommodate the attachments of various accessories thereto.

Yet still another object of this invention is to provide a groover having alternate means for moving it on the surface of wet cement or concrete.

Still yet another object of this invention is to provide a groover tool that will impart both a straight groove and a groove of uniform depression in the surface of wet concrete.

Other objects will become apparent to those skilled in the art upon a reading of this disclosure.

These and other objects are accomplished by this invention generally speaking, by providing an elongated groover (having a length of at least about 36 inches) having a freely movable handle attached thereto. A grooving projection, rib or blade extends outwardly from the lower surface of the tool, and when moved along the surface of wet cement imparts the desired groove therein. The terminal ends of the groover rib is tapered inwardly from top to bottom to prevent digging in of the rib when removing the tool from the wet cement. On the upper surface of the tool are means to house and hold weights in place along the entire length of the upper surface of the tool. It is intended that conventional bricks or manufactured weights can be used as weights across the entire upper surface. It is not uncommon for the need of additional pressure to impart a uniform groove in the cement as the cement begins to harden. The grooving tool can usually be used initially without weights but as the concrete or cement hardens or becomes more firm, added weights will assist in a uniform grooving. Thus, the novel groover of this invention in its preferred embodiment has an elongated configuration, weight housings on its upper surface, a movable handle attachment, and tapered terminal portions of the groove rib to prevent digging in when the groover tool is removed after the groove has been accomplished.

It is also desirable in the preferred embodiment of this invention to have an attachment means on the upper surface of the tool for connection to a guide bar which is adapted to fit around a 2×4 board or other straightedge for guiding the groover tool along a straight line. The guide bar comprises an inverted U-shaped rectangular bar having a tail for attachment to the upper surface of the grooving tool. The inverted U-shaped structure will conform generally to the outline of a 2×4 (or other plank or straightedge) and will hug the 2×4 as it is moved along the length of the 2×4. The tail of the guide bar can have apertures therein for fitting around and locking onto a post or bolt extending upwardly from the surface of the groover tool. If desired, the groover tool, because it is elongated, can be used without the guide bar. However, there should be accommodations in the groover tool for the attachment of a guide bar when needed.

The novel tool of this invention is particularly suited to providing a straight groove in concrete with a substantially uniform groove depression or depth. The elongation of the tool is very instrumental in the tool's ability to impart a straight groove and follow a straight course in wet cement because, in many cases, it will cover at least a substantial portion of that surface. Since the handle means is freely movable and since the groover tool is elongated, it is easy to accomplish a straight line groove in the surface of the cement. The tool itself can be constructed of a non-corrosive metal, other suitable materials, wood or plastics or other synthetic materials. The handle can also be made from these materials providing it is strong and will withstand various pressures exerted thereon. Optionally upright members can be used on the upper surface of the groover tool to which rope or string or wire can be attached to pull the groover through the wet cement. However, a freely movably handle is by far the most preferred means of accomplishing movement of the tool along the wet concrete surface.

DESCRIPTION OF THE DRAWING AND PREFERRED EMBODIMENT OF THIS INVENTION

Figure 1:
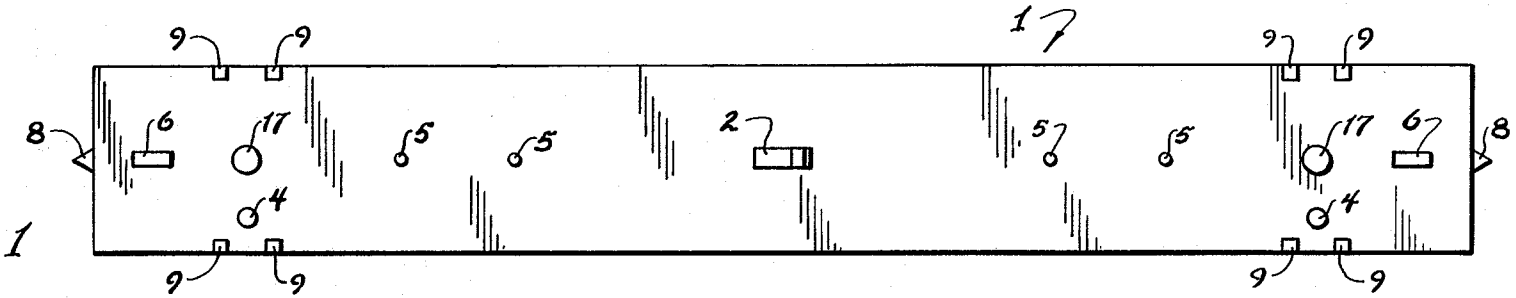
FIG. 1 is a top plan view of the groover tool of this invention.
Figure 2:
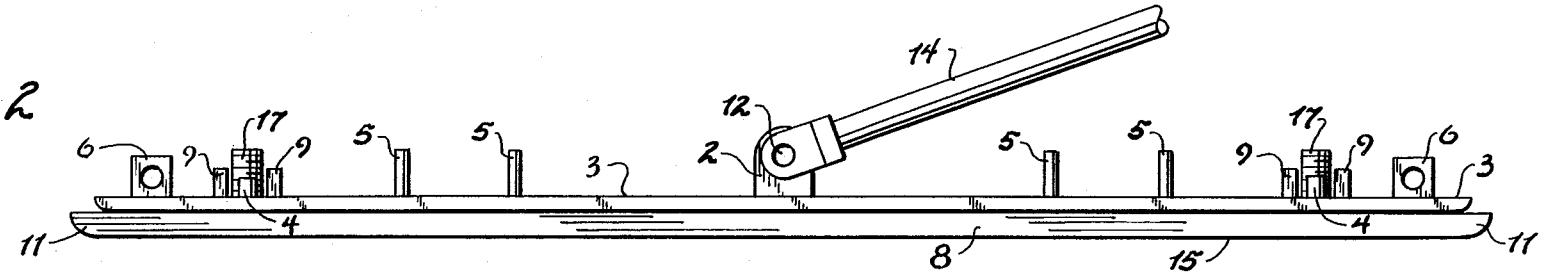
FIG. 2 is a side plan view of the groover tool of this invention.
Figure 3:
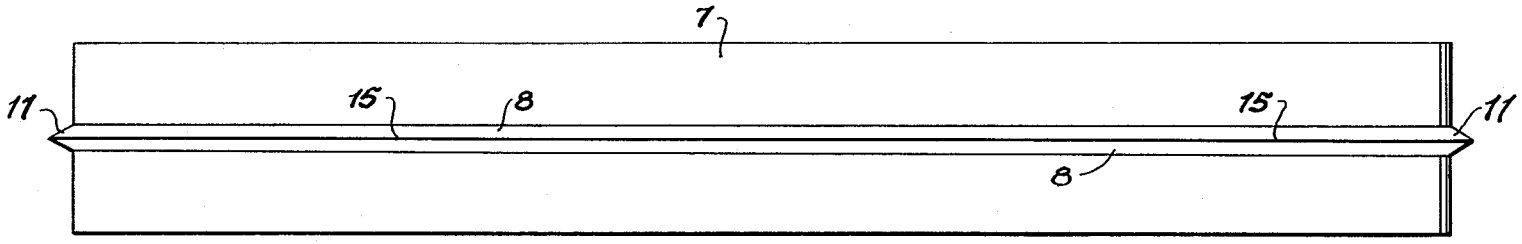
FIG. 3 is a bottom plan view of the groover tool of this invention.
Figure 5:
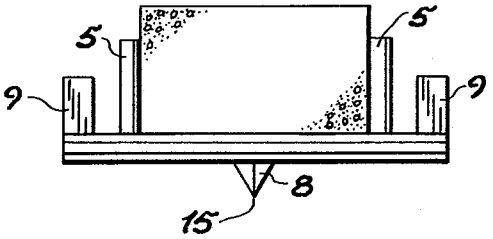
FIG. 5 is an end view of the groover tool of this invention showing a brick weight thereon.

In FIG. 1 a top view of the grooving tool 1 is illustrated having located at its center portion an upwardly projecting flange 2. A handle means later described can be attached to flange 2 in a manner to permit free movements of said handle of up to about 180° from its original position. Also located on the top surface 3 are posts 4 to which a guide bar can be connected. The guide bar is adapted to fit around a 2×4 board (or other straightedge) to insure that a groove is substantially straight. The guide bar will be described in detail in the discussion of FIGS. 6 and 7. Also located on upper surface 3 are weight retainers 5 that are used to hold weights such as conventional bricks in place. These retainers 5 can be pegs which fit into the apertures of bricks, or brackets spaced apart a distance approximating the dimensions of an ordinary brick. Any suitable retainer 5 may be used, as long as it holds the weight in place without permitting moving or shifting of the weight. In FIG. 5 retainers 5 are shown as brackets whereas in FIG. 1 they are shown as pegs. Any suitable means to retain weights may be used as retainers 5. Any number of retainers may be used depending upon the length of the groover tool 1 and the amount of weight desired. Optionally, eyelet members 6 may be positioned on upper surface 3. A pull cord can be attached to these eyelets if it is ever desirable to pull the tool 1 through wet cement. Located in lower surface, or bottom surface 7 (see FIG. 3) is the grooving rib 8 which projects slightly beyond the terminal ends of tool 1 as can be seen in FIGS. 1, 2 and 3. Bracket guides 9 project upwardly and have a spacing that will tightly hold a guide bar 10 (see FIGS. 6 and 7) in place. Grooving rib 8 tapers inwardly as it approaches its bottom surface as can be seen in FIG. 2. In FIG. 2 tapered end portion 11 of rib 8 slopes downwardly to minimize digging-in of the rib 8 when the tool 1 is withdrawn from the wet cement. The flange 2 has an aperture 12 therein into which a bolt 13 (see FIG. 8) will movably fit. Aperture 12 must be larger than the diameter of bolt 13 in order to permit bolt 13 to freely move therein and permit the handle 14 to be rotated up to 180° from its original position. It is important that handle 14 has this freedom of movement since a stationary or fixed handle can cause the tool 1 to skew or swerve upon a change in the pressure exerted because of distance of the user from the end of the cement to be grooved. The flange 2 and the handle 14 connecting means will be described more fully in reference to FIG. 8. Obviously, it is important to avoid any construction that will cause irregular grooves or grooves of non-uniform depth. By permitting movement of the handle, skewin of the tool 1 is minimized. Weight retainers 5 are illustrated as pegs 5, however, any suitable weight holder can be used upon the condition that these retainers 5 not permit significant movement or shifting of the bricks or weights housed in or connected thereto. Posts 4 are securely connected to the surface 3 of the grooving tool and are adapted to receive and together with bracket guides 9 hold a guide bar 10 in place. In some instances, it may be desirable to pull the grooving tool 1 through the wet cement and for this, eyelet members 6 are provided. Members 6 consist of an apertured bar that extends upward and located on both ends of the grooving tool 1, to accommodate pulling in either direction. However, it is preferred for best results to use the handle 14 when moving the tool 1 forward or backward in the wet cement.

In FIG. 3 the bottom surface 7 of the tool 1 is illustrated. Grooving rib 8 extends throughout the length of tool 1 and extends slightly beyond the terminal ends of tool 1 as shown at tapered end portion 11 of grooving rib 8. Tapered end portion 11 of grooving rib 8 is tapered inwardly as it approaches the bottom edge 15 of V-shaped groove or rib 8. Bottom surface 7 is generally constructed of a non-corrosive material that will readily slide on the wet cement. Also, rib 8 is constructed of a non-corrosive material that also easily moves through wet cement.

Figure 4:
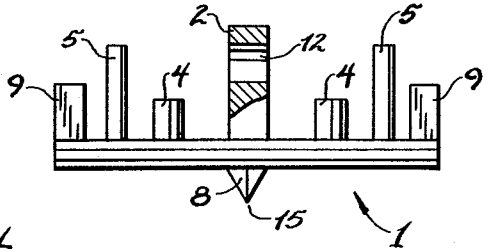
FIG. 4 is an end view of the groover tool of this invention.
Figure 6:
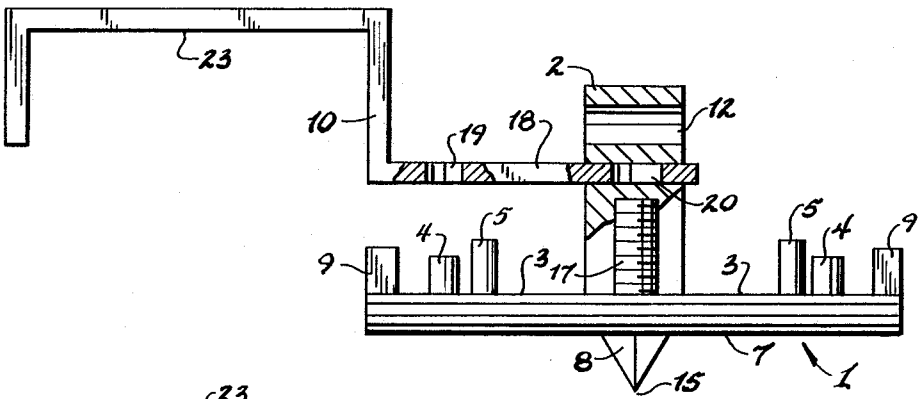
FIG. 6 is an end view of the groove tool and and guide bar of this invention before attachment. of this invention.
Figure 7:
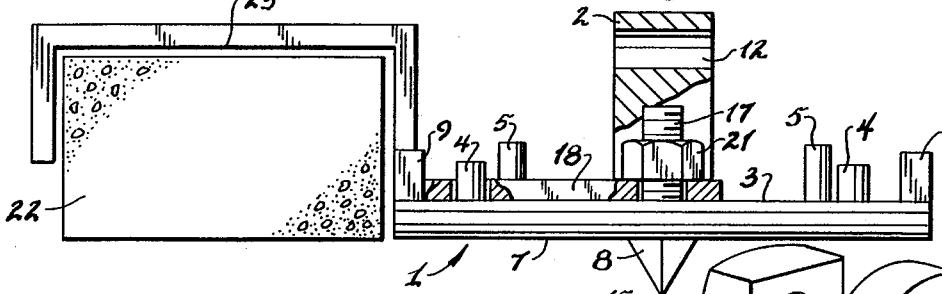
FIG. 7 is an end view of the groover tool and guide bar of this invention before attachment.

In FIG. 4 an end view of the tool 1 is illustrated showing clearly the V-shaped rib 8 as it grows thinner approaching bottom edge 15. In this figure the weights are not illustrated in order that the other components of the tool can be illustrated clearly. Flange 2 with aperture 2 is shown as it extends upward for easy connection to handle 14. Flange 2 is located centrally in tool 1, that is, it is in the center portion of the width of tool 1 and is in the center portion of the length of tool 1. This is important for proper balance and for imparting an optimum groove in the wet cement without any substantial distortions or irregularities in the groove. Since flange 2 is shown in FIG. 4, bolts 17 cannot be seen since they would be directly in front of and behind flange 2. To properly illustrate flange 2 the bolt 17 was not shown in front of flange 2. Posts 5 are shown extending upward to receive and hold common bricks in position on the upper surface 3. The amount of weight called for will be dictated by the stiffness or consistency of the wet cement. It may be desirable to initially use the elongated groover tool 1 without added weight but as concrete becomes firmer, weights may be added to achieve best results. The elongation of the groover tool 1 enables it when set on concrete to maintain a straight course while being moved by the handle 14. In the event a 2×4 board or other straight edge is to be used with groover tool 1, guide bar posts 4 and guide bar brackets 9 are used to attach rectangular guide bar 10 (see FIGS. 6 and 7) to groover tool 1. FIG. 5 illustrates the same end view as in FIG. 4; however, in FIG. 5, a weight 16 (brick) is shown held firmly between posts or weight brackets 5. Brackets (of FIG. 5) or pegs 5 (of FIG. 1) can be located either closer to the center (of the width of tool 1) as shown in FIG. 5 or they can be located closer to the edge of tool 1 as shown in FIG. 4. FIG. 4 shows element 9 which can run along the complete length of tool 1 (bracket guide 9) closest the edge, next element 5 (or pegs 5) and closest the center element 4 (or posts 4). FIG. 5 shows element 9 outermost, next element 4, and closest the center element 5. Either the arrangement of FIG. 4 or FIG. 5 may be used. Also, as shown in FIGS. 6 and 7, a centrally located (central to width not length) bolt 17 is also used to connect the rectangular guide bar 10 to tool 1. Thus, edge bracket guides 9, posts 4 and bolt 17 are all used to connect guide bar 10 to tool 1 and insure a minimum of movement of bar 10 when conforming to the straight-edge of a 2×4 (22) or other board. In FIG. 6 a rectangular guide bar 10 is shown before attachment to groove tool 1. Guide bar 10 can have an inner rounded periphery to minimize snagging on the 2×4 or other straight-edge used. Guide bar 10 has a tail 18 that has an aperture 19 to fit over post 4 and a second aperture 20 near its end to fit over and connect to bolt 17, fixed by nut 21 or other suitable means such as a wing nut, etc. Behind bolt 17 can be seen flange 2 to which the handle 14 is connected. The rectangular guide bar has one side missing so that it can fit over and conform to the contour of a 2×4 (or other straightedge). Bracket guides 9 hold the guide bar secure so that there is no lateral movement when attached to the tool 1. The 2×4 (22) is shown smaller than the inner contour of bar 10 for illustrative purposes, actually, it will be substantially the same dimensions as the inner periphery 23 of bar 10 so that it will fit snuggly around 2×4 (22) and adhere to its straightedge along its length.

Figure 8:
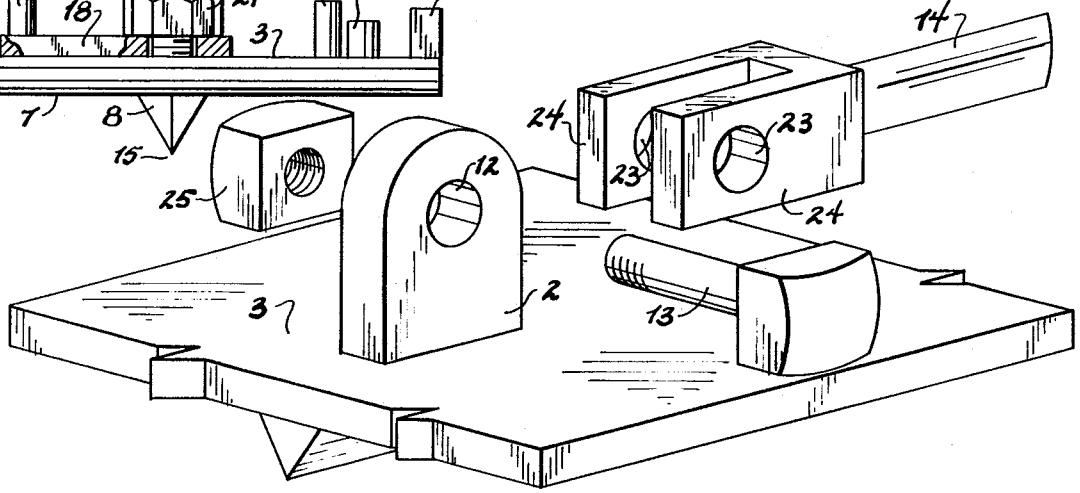
FIG. 8 is a breakaway view of the components of the handle connection portion of the tool of this invention.

In FIG. 8 an exploded view of the handle 16 connection is shown. Flange 2 is shown projecting upward from the top surface 3 of grooving tool 1. Flange 2 has an aperture 2 therein for receiving a bolt 13 which in turn is inserted through the apertures 23 in the fork 24 at the terminal end of handle 14. A nut 25 is used to tighten and secure handle 14 to flange 2. The bolt 13 should have a diameter smaller than that of apertures 12 and 23. This will permit handle 14 to move freely thereby preventing upswings or other movements which could cause tool 1 to dig in and distort the groove being formed. Handle 14 is capable of moving up to 180° from one side to the other if required.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A groover tool for use in grooving wet cement which comprises a main elongated body having a substantially flat upper and lower surface, said lower surface containing in its center portion and substantially coextensive therewith a grooving rib having a substantially V-shaped configuration, said grooving rib extending slightly beyond terminal end portions of said lower surface, the terminal ends of said rib tapered in a downward manner, said upper surface having at substantially its center portion a flange for connection to a movable handle means, said flange containing means for allowing said movable handle freedom of movement therein, said upper surface having upwardly projecting housings for retaining weights therein, said upper surface also having guide bar means for attachment thereto of a guide bar, said guide bar having an inverted U-shaped configuration with a tail section extending therefrom, and said guide bar means adapted to attach to said tail of said guide bar wherein said guide bar tail is fixed at substantially a right angle to a length portion of said groover tool.

2. The tool of claim 1 wherein said means to hold weights are pegs which are suitable to fit into apertures in a common brick.

3. The tool of claim 1 wherein said means to hold weights are brackets spaced apart at a slightly greater distance than the dimensions of a common brick, said means to hold weight adapted to retain said weights so that they do not shift or move.

4. The tool of claim 1 wherein said guide bar means comprises at least one bolt or rod extending upward from said upper surface.

5. The tool of claim 1 wherein said housings for retaining weights are pegs which are suitable to fit into apertures in a common brick.

6. The tool of claim 1 wherein said housings for retaining weights are brackets spaced apart at a distance slightly greater than the dimensions of a common brick.

7. The tool of claim 1 wherein at least two sets of guide bar means and of means to retain weights are positioned on the upper surface of said tool.

8. The tool of claim 1 wherein said guide bar means comprises at least one bolt or rod extending upward from said upper surface.

9. The tool of claim 1 wherein said upper surface contains at least two eyelets for attachment of pull strings, ropes and wires, said eyelets located near the terminal end portions of said upper surface.

* * * * *